US005111835A

United States Patent [19]

Lin

[11] Patent Number: 5,111,835

[45] Date of Patent: May 12, 1992

[54] WATER COLLECTING HANDLE WITH A FOLDABLE SHEATH FOR A FOLDING UMBRELLA

[76] Inventor: Hou-Tu Lin, Changhua, Taiwan

[21] Appl. No.: 719,439

[22] Filed: Jun. 24, 1991

[51] Int. Cl.[5] ..... A45B 25/28

[52] U.S. Cl. ..... 135/34.2; 135/48

[58] Field of Search ..... 135/48, 34.2

[56] References Cited

U.S. PATENT DOCUMENTS

| | | | |
|---|---|---|---|
| 148,573 | 3/1874 | Moschowitz | 135/34.2 |
| 337,145 | 3/1886 | Ghezzi | 135/48 |
| 2,545,022 | 3/1951 | Crewdson | 135/34.2 |
| 2,808,066 | 10/1957 | Pugliese | 135/48 |
| 4,350,175 | 9/1982 | DeMarco | 135/34.2 |

FOREIGN PATENT DOCUMENTS

| | | | |
|---|---|---|---|
| 703128 | 4/1966 | Italy | 135/34.2 |

*Primary Examiner*—Henry E. Raduazo
*Attorney, Agent, or Firm*—Browdy and Neimark

[57] ABSTRACT

The present disclosure is related to a water collecting handle with a foldable sheath received therein which is engaged to the bottom of a folding umbrella. The handle is equipped with a downward movable cap that is provided with a cork-like element at the bottom thereof so that water collected in the handle can be discharged therefrom. The handle has room at the bottom thereof to receive the foldable sheath which is secured at one end to the inside of the handle and the other end thereof is opened with a pull cord attached thereto. An identification card is secured to the pull cord. When the received sheath is pulled out and extended upward to wrap the collapsed umbrella, the rain-dampened umbrella is completely enclosed in the sheath and the remaining rain water collected drip by drip in the cap.

5 Claims, 4 Drawing Sheets

WATER COLLECTING HANDLE WITH A FOLDABLE SHEATH FOR A FOLDING UMBRELLA

FIELD OF THE INVENTION

The present invention is directed to a water collecting handle with a foldable sheath received therein which can be pulled out extendably to sealingly enclose a rain dampened umbrella so that water adhering to the same can be totally collected without making the surroundings wet when carrying the umbrella around. The water collected drop by drop can be discharged from the bottom of the handle when a cork element is removed from cap disposed at the bottom of the handle. By pulling the cap downward, a slot opening is exposed and the extended sheath can be stuffed automatically into a room in the handle when the umbrella is opened. An identification card is attached to a pull cord employed to tighten and loosen the top opening of the sheath and is exposed outside at the bottom of the handle when the sheath is stuffed therein.

Conventional folding umbrella 20 is usually provided with a sheath 30, as shown in FIG. 1, with a handle 21 disposed at the bottom and a head cap 22 secured at the top thereof. The handle 21 is generally used to facilitate the holding of the umbrella, and the sheath 30 must be removed to permit the umbrella to extend and open. It is common that the sheath 30 is left behind and lost thereby resulting in a rain-dampened umbrella wetting the surroundings.

People entering a room or a vehicle usually have to violently shake the umbrellas to get rid of the water thereon, then put the sheaths onto the umbrellas.

The inventor has noted the disadvantages of conventional folding umbrellas, and developed a water-collecting handle with a sheath receivingly stuffed therein. An identification card is attached to the pull ring at the top of the opened sheath so that the umbrella can be easily identified.

SUMMARY OF THE INVENTION

The primary object of the present invention is to provide a handle attached to the bottom of the outer shaft of a conventional spring actuated telescoping umbrella which can collect water from a rain-dampened umbrella drip by drip and the water can be discharged from an opening disposed at the bottom of a cap secured to the end of the handle.

Another object of the present invention is to provide a handle with a sheath receiving compartment so that a foldable sheath stuffed therein can be extended upward to enclose the umbrella totally.

To better illustrate the structure, operation modes and features of the present invention, a detailed description of the present invention is given along with the following drawings, in which

DETAILED DESCRIPTION OF THE PREFERRED EMBODIMENT

Figure 1:
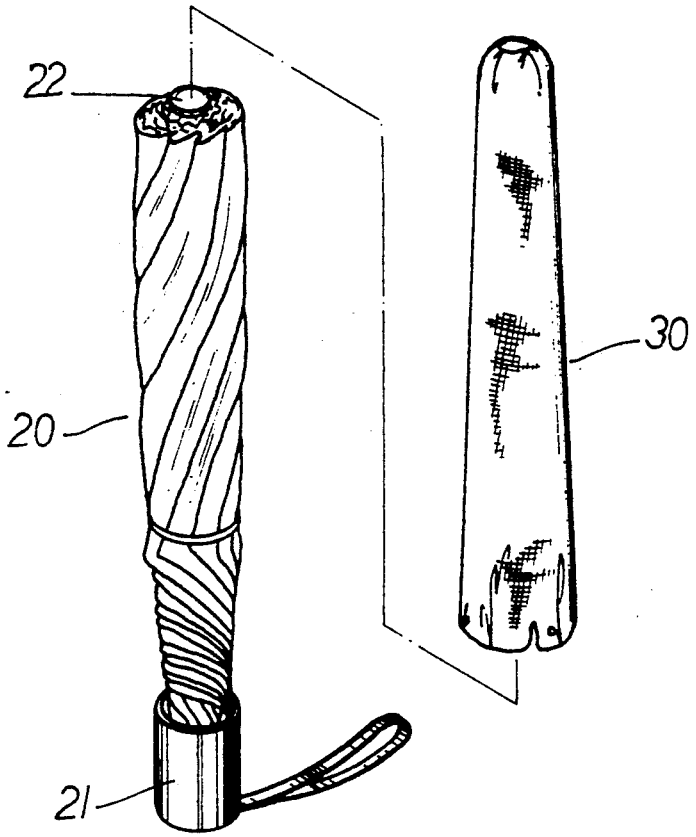
FIG. 1 (PRIOR ART)
FIG. 1 is a diagram showing a prior art umbrella and a separate sheath thereof.
Figure 2:
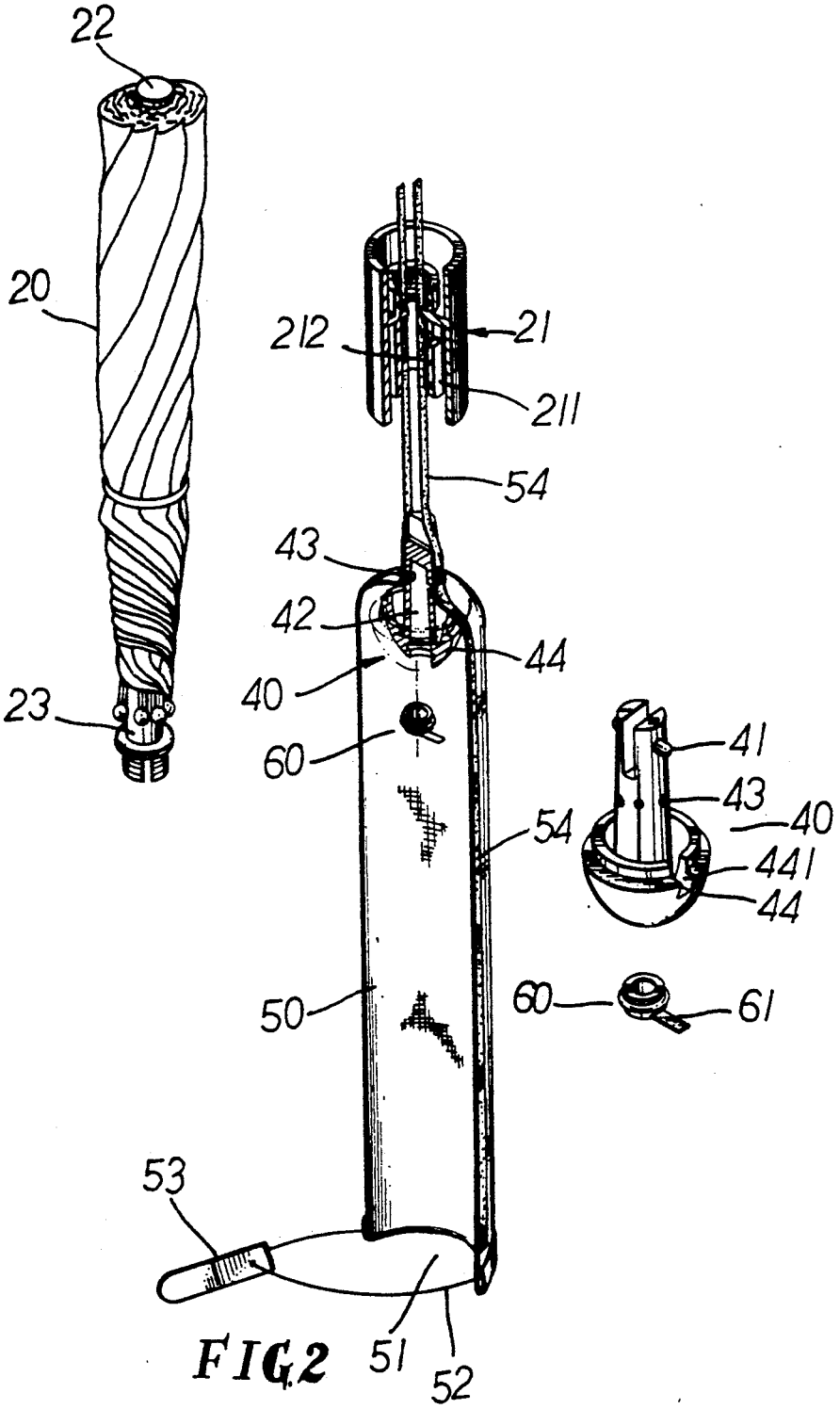
FIG. 2 is a perspective view of the exploded components of the present invention.

Referring to FIG. 2, a water-collecting handle 21 of the present invention is mounted to the bottom of the outer shaft 23 of a conventional folding umbrella 20 which is provided with a head cap element 22. A tubular compartment 211 is defined in the handle 21 with a pair of reverse L-shaped guide slots 212 on the wall thereof. A reverse mushroom shaped cap 40 is removably attached to the bottom of the handle 21 with a pair of protrusions 41 disposed on a truncated cone which projects from the cap. When protrusions 41 are engaged with the guide slots 212 they prevent the cap 40 from disengaging from handle 21. A hollow portion 42 is defined in the truncated cone projection of the cap with an opening 442 disposed at the bottom of the holow portion 42. A cork element 60 is used to block the opening 442. More than one through hole 43 is defined on the truncated cone projection. The half sphere shaped bottom 44 of the cap 40 is provided with a slot 441 along the edge thereof. Slot 441, forms an opening when the cap 40 is secured to the handle 21.

Figure 3:
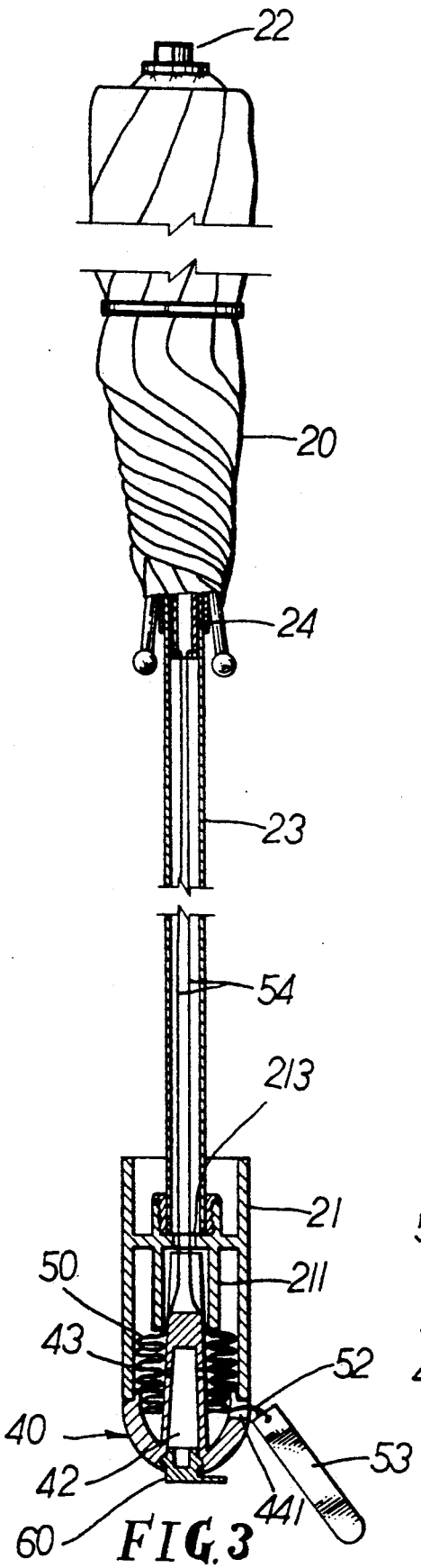
FIG. 3 is a sectional diagram showing the water-collecting handle secured to the bottom of an extended folding umbrella.
Figure 5:
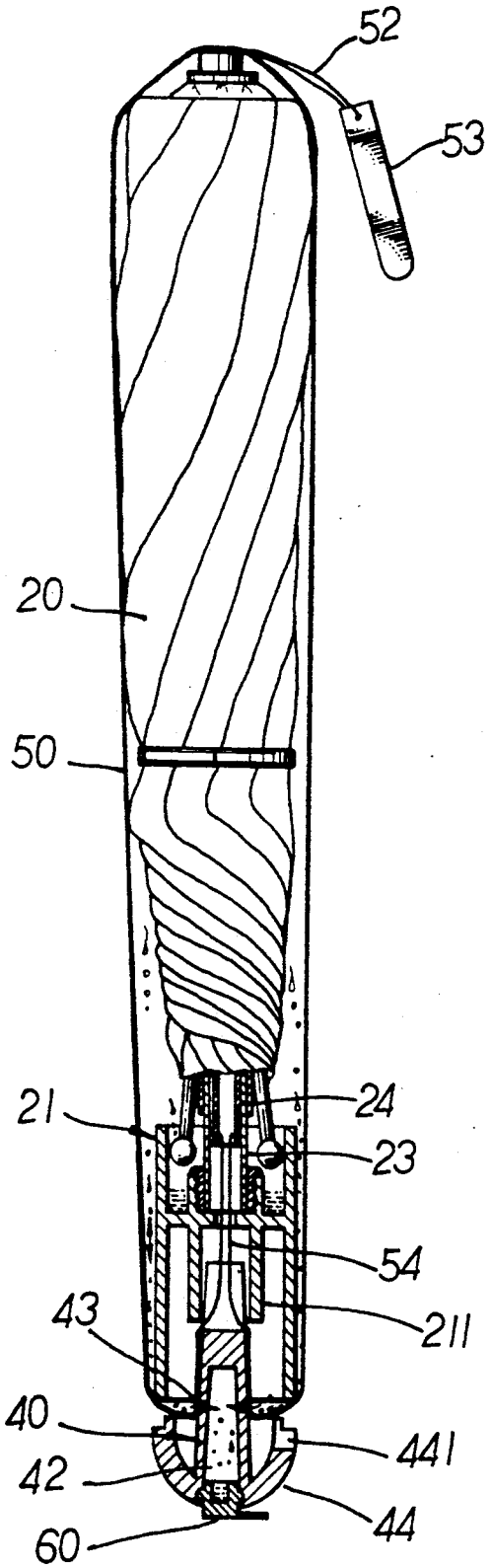
FIG. 5 is a diagram showing how the water from a rain-dampened umbrella enclosed by the sheath of the present invention is collected in the handle.

As shown in FIGS. 2 and 5 a sheath 50 with its bottom edge slidably engaged below through holes 43 of the cap 40 can be extended upward around folded umbrella 20 through an opening 51 which is provided with a pull cord 52 having an identification card 53 attached thereto. When the umbrella 20 is extended to be opened, elastic cords 54 which are sewn spacedly around the bottom end of the sheath 50 at opening 51 automatically draw sheath 50 into a folded and small size within handle 21, as shown in FIG. 3. This is achieved when the ends of the elastic cords 54 extended through the hole 213 into the interior of the first metal rod 23 and secured to the bottom end of the second metal rod 24 move upward with the end of rod 24 when the umbrella opens. Rods 23 and 24 are respectively shown in the drawings as the outer and inner shafts of a spring actuated umbrella.

Figure 4:
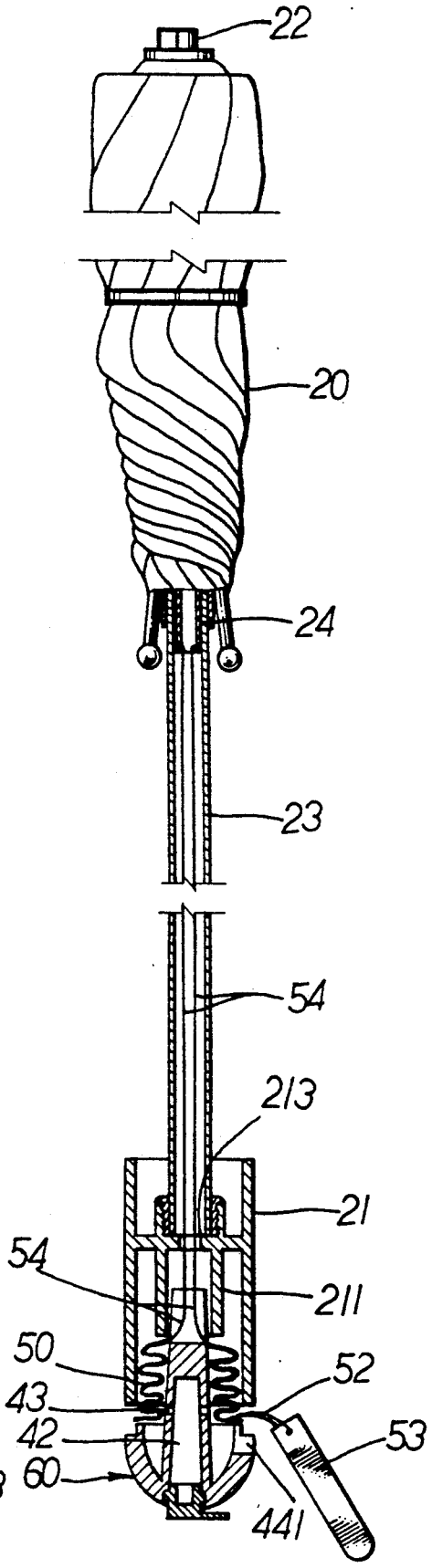
FIG. 4 is a sectional diagram showing how a received sheath can be pulled out from its housing when a cap secured at the bottom of the handle is released and pulled downward.

As shown in FIG. 4, the cork element 60 is removably secured to the bottom end of the hollow portion 42 of the cap 40; an extended pull strap 61 is disposed on cap 40 to facilitate its removal.

As clearly illustrated in FIG. 3, the foldable sheath 50 will be retracted into the bottom portion disposed under the tubular compartment 211 of the handle 21 when the umbrella is. This is accomplished when second metal rod 24 is telescopically pulled upward within the first metal rod 23 and most of the elastic length of cords 54 are extended into the first metal rod 23. As a result of the elastic withdrawal of the elastic cords 54, the foldable sheath 50 will be automatically received in the room defined at the bottom of the handle 21. As shown in FIG. 3, while cap 40, is kept in engagement with handle 21 by a pair of protrusions 41 in engagement with the reverse L-shaped guide slots 212 on the wall of the tubular compartment 211 of the handle 21, sheath 50 in the position shown in FIG. 2 is automatically pulled upward due to the elastic pulling of the elastic cords 54 to seal the sheath 50 in the handle 21 only with the ID card 53 attached to the pull cord 52 exposed.

Figure 6:
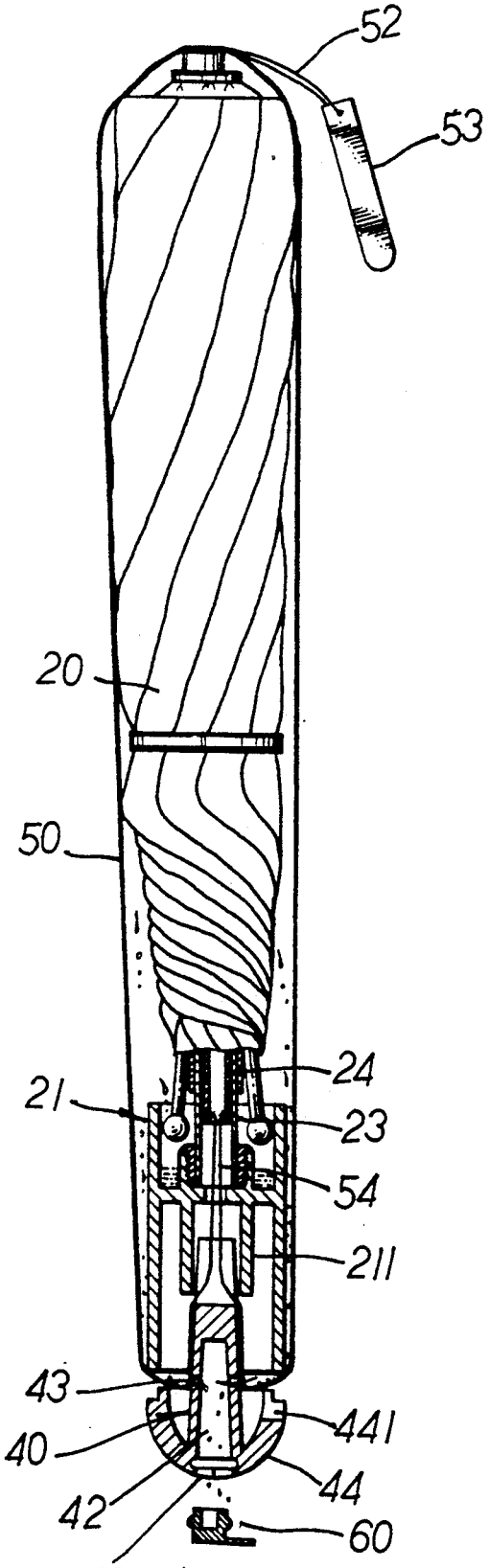
FIG. 6 is a diagram showing how the collected water can be discharged from the bottom of the extendable cap when a cork element is removed from the bottom of the cap.

Referring to FIG. 4, after a rain, the person using the umbrella of the present invention will enter a shelter or a car and collapse and fold the umbrella 20 first. Thereafter, the user can pull down the cap 40 by turning the cap and disengaging protrusions 41 from reverse L-shaped slots 212. When collapsing the umbrella, the first metal rod 23 of the folding umbrella is forced into the second metal rod 24 thereof with the elastic cords 54 gathering in the handle 21 so that the sheath 50 can be freed to extend outward between the loosened cap 40 and handle 21. Thereafter sheath 56 can be pulled out and turned upward to wrap the whole umbrella therein, as shown in FIGS. 2 and 5. As shown in FIGS. 5 and 6 when sheath 50 is fully pulled out of the umbrella, the end of sheath 50 remaining in contact with the truncated cone of cap 40 is positioned below holes 43 so that the sheath 50 directs entrapped water through holes 43 into hollow portion 42 of cap 40. Afterwards, the pull cord 52 is pulled tight to close the opening 51. An the rain-dampened umbrella is totally wrapped in the sheath 50, water on the umbrella will roll down along the wall of the sheath 50 and gather in the hollow portion 42 through the through holes 43 of the cap 40. To discharge the collected water, the user of the umbrella only has to pull the cork 60 away from the cap 40, as shown in FIG. 6.

It is apparent that the water collecting handle 21 with a sheath 50 received therein of the present invention has solved the problems a rain dampened rain umbrella can cause. The wet umbrella can be easily wrapped by the receivable sheath 50 and water thereon can be gathered in the handle 21 and discharged at proper time. The sheath 50 attached to the handle 21 will not be lost as long as the umbrella is not left behind.

I claim:

1. A water-collecting handle for connection to the bottom of an outer hollow shaft of a conventional telescoping umbrella having an inner shaft which slides outward in said outer hollow shaft when said umbrella is actuated open by the force of a spring, said water-collecting handle comprising;

hollow tubular handle means connected to said bottom of said outer hollow shaft for holding said umbrella and for housing a folded sheath, a folded sheath for covering a collapsed umbrella when said sheath is extended open, said folded sheath housed in said hollow tubular handle means, cap means separably engageable to said hollow tubular handle means for sealing said folded sheath in said hollow tubular handle means when said cap means is engaged and for gaining access to extend said folded sheath and collecting water off of a collapsed and wet umbrella enclosed by an extended sheath when said cap means is disengaged from said hollow tubular handle means, a first end of said folded sheath slidably engaged on a projection on said cap means and said projection being insertable into said hollow tubular handle means, a plurality of elastic cords engaged to said first end of said folded sheath, said elastic cords engaged to an end of said inner shaft slidable in said outer shaft so that an extended sheath is automatically pulled into and folded in said tubular handle means when said umbrella is opened.

2. A water-collecting handle in accordance with claim 1 wherein, said projection on said cap means has a hollow portion communicating with a surface on said projection through a plurality of holes, said first end of said foldable sheath is engaged below said plurality of holes when said sheath is extended to enclose a collapsed and wet umbrella thereby permitting water to move through said plurality of holes into said hollow portion of said cap means, said cap means has a cork to release water collected in said hollow projection.

3. A water-collecting handle in accordance with claim 1 wherein, said projection on said cap means has an opening permitting said elastic cords to enter said outer hollow shaft while limiting entry of said sheath when said cap means is disengaged from said hollow tubular handle means.

4. A water-collecting handle in accordance with claim 3 wherein, said foldable sheath has a pull cord around a second open end with an identication card attached to said cord.

5. A water-collecting handle in accordance with claim 4 wherein, said cap means has a notch which permits said identification card to hang outside said cap means and said hollow tubular handle means when engaged.

* * * * *